US009008564B2

(12) United States Patent
Sakamoto

(10) Patent No.: US 9,008,564 B2
(45) Date of Patent: Apr. 14, 2015

(54) IMAGE FORMING APPARATUS AND SHEET FEEDING DEVICE

(75) Inventor: Toyohide Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 129 days.

(21) Appl. No.: 13/035,211

(22) Filed: Feb. 25, 2011

(65) Prior Publication Data

US 2011/0318079 A1 Dec. 29, 2011

(30) Foreign Application Priority Data

Jun. 24, 2010 (JP) ..... 2010-144043

(51) Int. Cl.

| | |
|---|---|
| ***G03G 15/00*** | (2006.01) |
| ***B65H 5/06*** | (2006.01) |
| ***A47B 88/14*** | (2006.01) |
| ***B65H 1/26*** | (2006.01) |

(52) U.S. Cl.

CPC ..... *G03G 15/6505* (2013.01); *A47B 88/14* (2013.01); *B65H 1/266* (2013.01); *B65H 2402/53* (2013.01); *B65H 2405/114* (2013.01)

(58) Field of Classification Search

CPC ..... A47B 88/12; A47B 88/14
USPC ..... 399/388; 271/9.13, 264, 145, 3.08, 271/4.01, 164; 248/27.1, 298.1; 312/334.12, 334.18, 334.25, 334.39, 312/334.45, 334.1, 334.6, 334.7, 334.8, 312/334.14, 334.15, 334.21, 334.27
See application file for complete search history.

(56) References Cited

U.S. PATENT DOCUMENTS

| | | | | |
|---|---|---|---|---|
| 5,364,088 | A * | 11/1994 | Maruyama et al. | 271/164 |
| 5,413,409 | A * | 5/1995 | Arai | 312/330.1 |
| 6,115,568 | A * | 9/2000 | Sameshima | 399/110 |
| 2008/0260443 | A1 * | 10/2008 | Noguchi | 399/381 |
| 2008/0284086 | A1 * | 11/2008 | Kawasaki et al. | 271/145 |

FOREIGN PATENT DOCUMENTS

JP 11-171362 A 6/1999

OTHER PUBLICATIONS

Communication dated Nov. 4, 2014, issued by the State Intellectual Property Office of the People's Republic of China in corresponding Chinese Application No. 201110085001.7.

* cited by examiner

*Primary Examiner* — Daniel J Colilla
*Assistant Examiner* — John M Royston
(74) *Attorney, Agent, or Firm* — Sughrue Mion, PLLC

(57) ABSTRACT

An image forming apparatus includes a recording-medium storing unit including a rotating member, the recording-medium storing unit being capable of being pulled out from an apparatus body; a support surface having an edge portion, the support surface supporting the rotating member when the recording-medium storing unit is pulled out from the apparatus body; and an image forming unit that forms an image on a recording medium fed from the recording-medium storing unit. The rotating member has a counter surface that faces the edge portion when the rotating member moves beyond the edge portion and drops off the support surface in a certain direction. In the state in which the counter surface faces the edge portion, the counter surface is inclined such that a point on the counter surface approaches the edge-portion side as the point moves in a direction opposite to the certain direction.

10 Claims, 9 Drawing Sheets

IMAGE FORMING APPARATUS AND SHEET FEEDING DEVICE

CROSS-REFERENCE TO RELATED APPLICATIONS

This application is based on and claims priority under 35 USC 119 from Japanese Patent Application No. 2010-144043 filed Jun. 24, 2010.

BACKGROUND

The present invention relates to an image forming apparatus and a sheet feeding device.

SUMMARY

According to an aspect of the invention, there is provided an image forming apparatus including a recording-medium storing unit including a rotating member, the recording-medium storing unit being capable of being pulled out from an apparatus body; a support surface having an edge portion, the support surface supporting the rotating member when the recording-medium storing unit is pulled out from the apparatus body; and an image forming unit that forms an image on a recording medium fed from the recording-medium storing unit. The rotating member has a counter surface that faces the edge portion of the support surface when the rotating member moves beyond the edge portion and drops off the support surface in a certain direction. In the state in which the counter surface faces the edge portion, the counter surface is inclined such that a point on the counter surface approaches the edge-portion side as the point moves in a direction opposite to the certain direction.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described with reference to the accompanying drawings.

Figure 1:
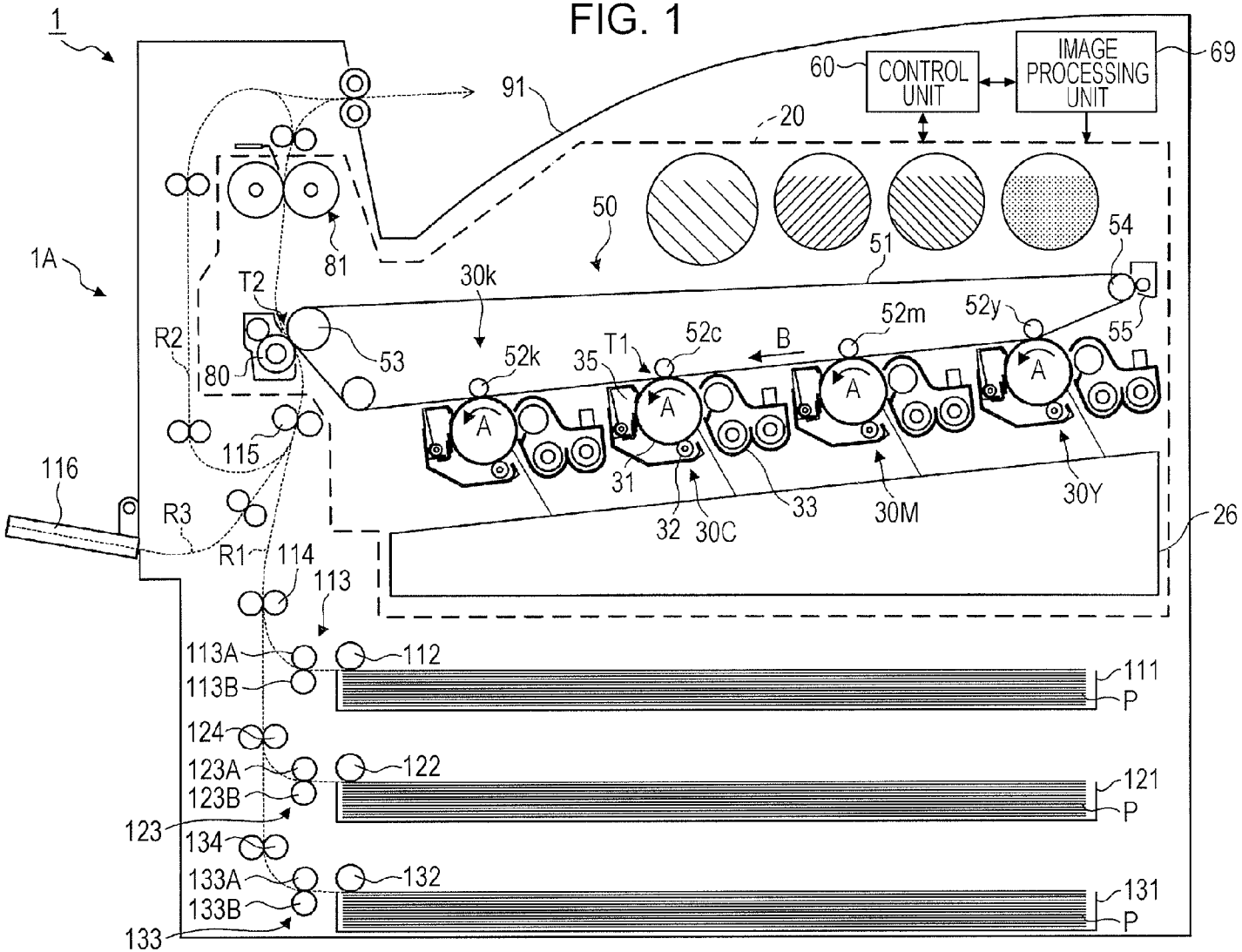
FIG. 1 illustrates the overall structure of an image forming apparatus.

FIG. 1 illustrates the overall structure of an image forming apparatus 1. The image forming apparatus 1 is a so-called tandem color digital printer using electrophotography. The image forming apparatus 1 includes an image forming process unit 20 as an image forming unit. The image forming process unit 20 is disposed in an apparatus body 1A, and performs image forming in accordance with image data of respective colors. The image forming apparatus 1 also includes a control unit 60 that controls the operations of components and devices disposed in the apparatus body 1A. The image forming apparatus 1 also includes an image processing unit 69 and a storage unit (not shown). The image processing unit 69 subjects image data received from, for example, a personal computer (PC) (not shown) or a scanner to image processing. The storage unit is formed of, for example, a hard disc drive in which processing programs, image data, etc., are stored.

The image forming process unit 20 includes four image forming units 30Y, 30M, 30C, and 30K (hereinafter also generically referred to as "image forming units 30") which are arranged in parallel at constant intervals in the left-right direction. Each image forming unit 30 includes a photoconductor drum 31 on which an electrostatic latent image is formed while the photoconductor drum 31 rotates in the direction shown by arrow A; a charging roller 32 which charges the surface of the photoconductor drum 31; a developing device 33 that develops the electrostatic latent image formed on the photoconductor drum 31 with toner of the corresponding color; and a drum cleaner 35 that cleans the surface of the photoconductor drum 31 after transferring. Each image forming unit 30 is attached to the apparatus body 1A in a replaceable (removable) manner. When the life of, for example, the photoconductor drum 31 ends, the entire image forming unit 30 is replaced with a new unit.

The charging roller 32 is formed of a roller member in which a conductive elastic layer and a conductive surface layer are stacked on a conductive core bar made of aluminum, stainless steel, or the like. The charging roller 32 receives a charging bias voltage from a charging power source (not shown) and charges the surface of the photoconductor drum 31 while being rotated by the rotation of the photoconductor drum 31. The developing device 33 stores two-component developer including toner of yellow (Y), magenta (M), cyan (C), or black (K) and magnetic carrier in each image forming unit 30. The developing device 33 develops the electrostatic latent image formed on the photoconductor drum 31 with the toner of the corresponding color. The drum cleaner 35 brings a plate-shaped member formed of a rubber material, such as urethane rubber, into contact with the surface of the photoconductor drum 31 to remove toner, paper powder, etc., from the photoconductor drum 31.

The image forming process unit 20 includes a laser exposure device 26 that emits light toward the photoconductor drums 31 included in the respective image forming units 30. The laser exposure device 26 receives the image data of respective colors from the image processing unit 69 and scans the photoconductor drums 31 in the image forming units 30 with laser beams that are subjected to on-off control based on the received image data. The image forming process unit 20 also includes a belt unit 50. To allow maintenance and the like of the belt unit 50 and replacement thereof with a new belt unit 50, the belt unit 50 is detachably attached to the apparatus body 1A (such that the belt unit 50 is detachable from the front side (the side visible in FIG. 1) of the apparatus body 1A. The belt unit 50 includes an intermediate transfer belt 51, first transfer rollers 52*y*, 52*m*, 52*c*, and 52*k*, a driver roller 53, and an idle roller 54.

The intermediate transfer belt 51 is an endless belt member, and is stretched around at least the idle roller 54 and the driver roller 53. The intermediate transfer belt 51 is rotated by the driver roller 53, which is driven by a motor (not shown) having a good constant-speed performance. Toner images of respective colors formed on the photoconductor drums 31 in the image forming units 30 are transferred onto the intermediate transfer belt 51 in a superimposed manner. The first transfer rollers 52$y$, 52$m$, 52$c$, and 52$k$ are disposed inside the intermediate transfer belt 51 and are opposed to the respective photoconductor drums 31. Each of the first transfer rollers 52$y$, 52$m$, 52$c$, and 52$k$ forms a transfer electric field between itself and the corresponding photoconductor drum 31. Thus, the toner images of respective colors formed in the image forming units 30 are successively transferred onto the intermediate transfer belt 51 at first transfer sections T1 (first transfer process).

The image forming process unit 20 also includes a second transfer roller 80 and a fixing device 81. The second transfer roller 80 transfers the toner images that have been transferred onto the intermediate transfer belt 51 in the belt unit 50 in a superimposed manner onto a sheet P, which is a recording medium (recording paper), at a second transfer section T2 (second transfer process). The fixing device 81 fixes the image that has been transferred onto the sheet P by the second transfer process.

The image forming apparatus 1 includes a first sheet storing unit 111 which stores sheets P to be fed to the second transfer section T2. The first sheet storing unit 111 is box-shaped or substantially box-shaped with an open side at the top, and stores the sheets P. The first sheet storing unit 111 is configured such that the first sheet storing unit 111 is capable of being pulled out from the front side of the image forming apparatus 1 (the side visible in FIG. 1). In the present exemplary embodiment, the first sheet storing unit 111 may be refilled with new sheets P by pulling out the first sheet storing unit 111 from the front side.

The image forming apparatus 1 includes a sending-out roller 112 that is in contact with the topmost sheet P in the stack of sheets P stored in the first sheet storing unit 111 and sends out the topmost sheet P. The image forming apparatus 1 also includes a sheet-separating mechanism 113 including a feed roller 113A which is arranged to be rotatable and a retard roller 113B whose rotation is regulated. The sheet-separating mechanism 113 separates the sheets P sent out by the sending-out roller 112 from each other and feeds the separated sheets P one at a time. The sheet P fed by the sheet-separating mechanism 113 is transported toward the second transfer section T2 by transport rollers 114.

In the present exemplary embodiment, a second sheet storing unit 121 is disposed below the first sheet storing unit 111. The second sheet storing unit 121 is an example of a recording-medium storing unit or a sheet storing unit. Similar to the first sheet storing unit 111, the second sheet storing unit 121 is box-shaped or substantially box-shaped with an open side at the top, and stores sheets P. In addition, similar to the first sheet storing unit 111, the second sheet storing unit 121 is capable of being pulled out from the front side.

In the present exemplary embodiment, a sending-out roller 122, which is an example of a sending-out member, is provided. The sending-out roller 122 is in contact with the topmost sheet P in the stack of sheets P stored in the second sheet storing unit 121, and sends out the topmost sheet P. In addition, a sheet-separating mechanism 123 is also provided. The sheet-separating mechanism 123 includes a feed roller 123A which is arranged to be rotatable and a retard roller 123B whose rotation is regulated. The sheet-separating mechanism 123 separates the sheets P sent out by the sending-out roller 122 from each other and feeds the separated sheets P one at a time. The sheet P fed by the sheet-separating mechanism 123 is transported toward the above-described transport rollers 114 by transport rollers 124.

The image forming apparatus 1 also includes a third sheet storing unit 131 disposed below the second sheet storing unit 121. Similar to the first sheet storing unit 111, the third sheet storing unit 131 is box-shaped or substantially box-shaped with an open side at the top, and stores sheets P. In addition, similar to the first sheet storing unit 111, the third sheet storing unit 131 is capable of being pulled out from the front side. In addition, similar to the above-described structures, a sending-out roller 132, a sheet-separating mechanism 133 including a feed roller 133A and a retard roller 133B, and transport rollers 134 are provided. The sending-out roller 132 sends out the topmost sheet P in the stack of sheets P stored in the third sheet storing unit 131. The sheet-separating mechanism 133 separates the sheets P from each other, and feeds the separated sheets one at a time. The transport rollers 134 transport the sheet P fed by the sheet-separating mechanism 133 toward the above-described transport rollers 124.

In the present exemplary embodiment, the image data output from the PC or the scanner (not shown) is subjected to image processing performed by the image processing unit 69 and is supplied to the laser exposure device 26. In, for example, the image forming unit 30C for forming a cyan (C) image, the surface of the photoconductor drum 31 that has been uniformly charged by the charging roller 32 is scanned with the laser beam that is subjected to on-off control performed by the laser exposure device 26 on the basis of the image data from the image processing unit 69. Thus, an electrostatic latent image is formed on the photoconductor drum 31. The electrostatic latent image is developed by the developing device 33, so that a cyan (C) toner image is formed on the photoconductor drum 31. Similarly, yellow (Y), magenta (M) and black (K) toner images are formed in the image forming units 30Y, 30M, and 30K, respectively.

The toner images of the respective colors formed by the image forming units 30 are successively electrostatically transferred onto the intermediate transfer belt 51 by the first transfer rollers 52$y$, 52$m$, 52$c$, and 52$k$ to which a first transfer bias is applied, while the intermediate transfer belt 51 is rotated by the driver roller 53 in the direction shown by arrow B in FIG. 1. Thus, a superimposed toner image is formed on the intermediate transfer belt 51. As the intermediate transfer belt 51 is rotated, the superimposed toner image is transported toward the second transfer section T2 in which the second transfer roller 80 and the driver roller 53 are arranged.

A sheet P is taken out from, for example, the first sheet storing unit 111 by the sending-out roller 112. The sheet P that has been taken out is separated from other sheets P by the feed roller 113A and the retard roller 113B in the sheet-separating mechanism 113, and is transported further downstream. Then, the sheet P is transported by the transport rollers 114 along a transport path R1 to the position where registration rollers 115 which regulate the position of the sheet P are disposed. Then, the sheet P is transported from the registration rollers 115 toward the second transfer section T2 at the time synchronized with the time when the superimposed toner image is transported to the second transfer section T2. In the second transfer section T2, the superimposed toner image is electrostatically transferred onto the sheet P by a transfer electric field formed between the second transfer roller 80 to which a second bias voltage is applied and the driver roller 53 (second transfer process).

Then, the sheet P on which the superimposed toner image has been electrostatically transferred is removed from the intermediate transfer belt 51 and is transported to the fixing device 81. The unfixed toner image formed on the sheet P transferred to the fixing device 81 is fixed by receiving heat and pressure in a fixing process performed by the fixing device 81. The sheet P on which a fixed image is formed is transported to a sheet support unit 91 included in an ejection section of the image forming apparatus 1. To prepare for the next image forming cycle, toner (remaining toner) and paper powder that remain on the intermediate transfer belt 51 after the second transfer process are removed by a belt cleaner 55 that is arranged to be in contact with the intermediate transfer belt 51.

An example in which the sheet P is fed from the first sheet storing unit 111 has been described above. When the sheet P is fed from the second sheet storing unit 121, first, the sheet P is taken out from the second sheet storing unit 121 by the sending-out roller 122. The sheet P that has been taken out is separated from other sheets P by the feed roller 123A and the retard roller 123B in the sheet-separating mechanism 123, and is transported further downstream. Then, the sheet P is transported to the second transfer section T2 by the transport rollers 124, the transport rollers 114, and the registration rollers 115.

When the sheet P is fed from the third sheet storing unit 131, first, the sheet P is taken out from the third sheet storing unit 131 by the sending-out roller 132. The sheet P that has been taken out is separated from other sheets P by the feed roller 133A and the retard roller 133B in the sheet-separating mechanism 133, and is transported further downstream. Then, the sheet P is transported to the second transfer section T2 by the transport rollers 134, the transport rollers 124, the transport rollers 114, and the registration rollers 115. The sheet P may also be transported to the second transfer section T2 along a double-sided-printing transport path R2 or a transport path R3 that is connected to a manual-feed sheet-retaining portion 116.

The first to third sheet storing units 111 to 131 will now be described in detail below. The first to third sheet storing units 111 to 131 have substantially the same structure, and the second sheet storing unit 121 will be described as an example.

Figure 2:
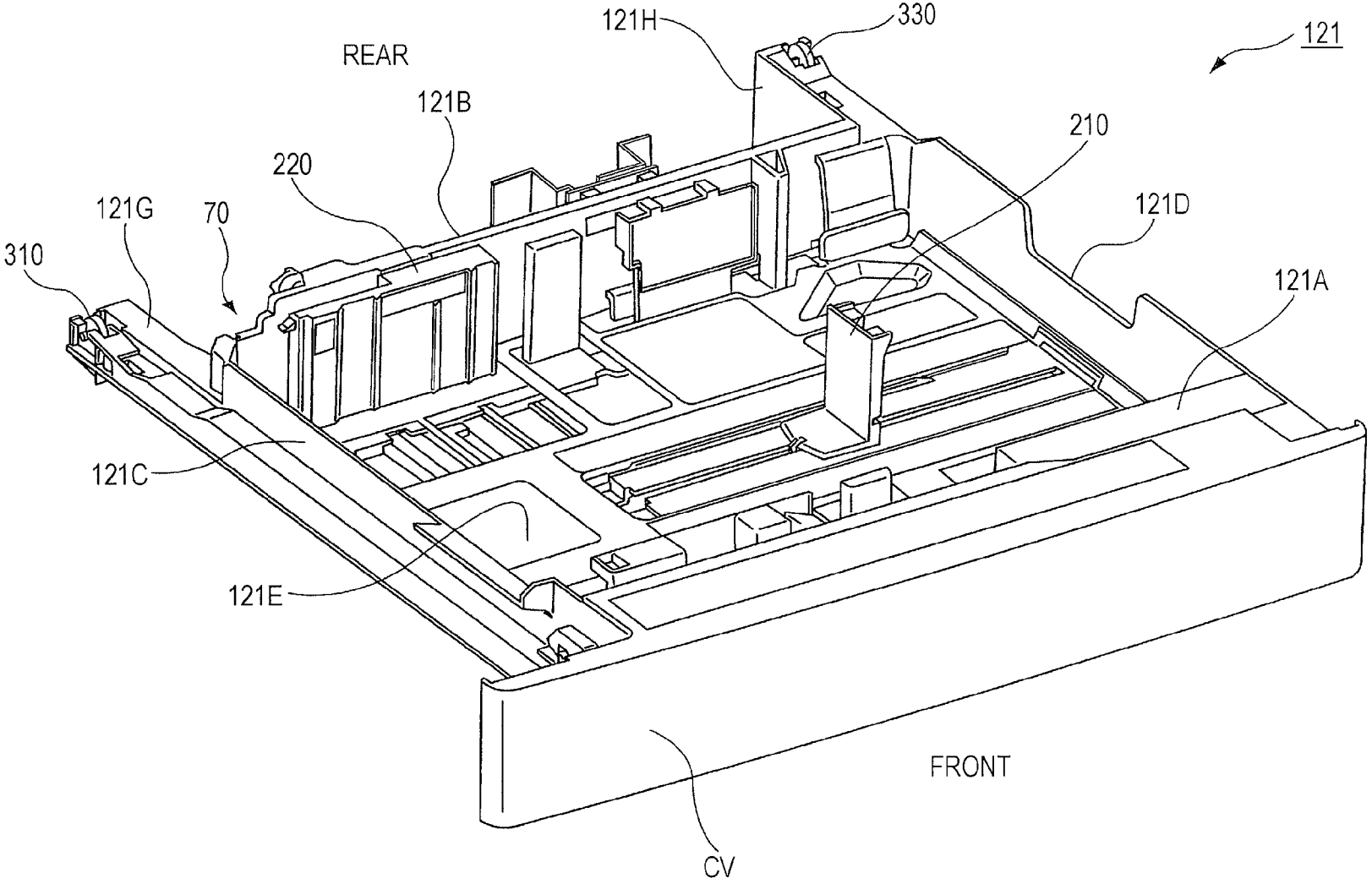
FIG. 2 is a perspective view of a second sheet storing unit viewed from above.
Figure 3:
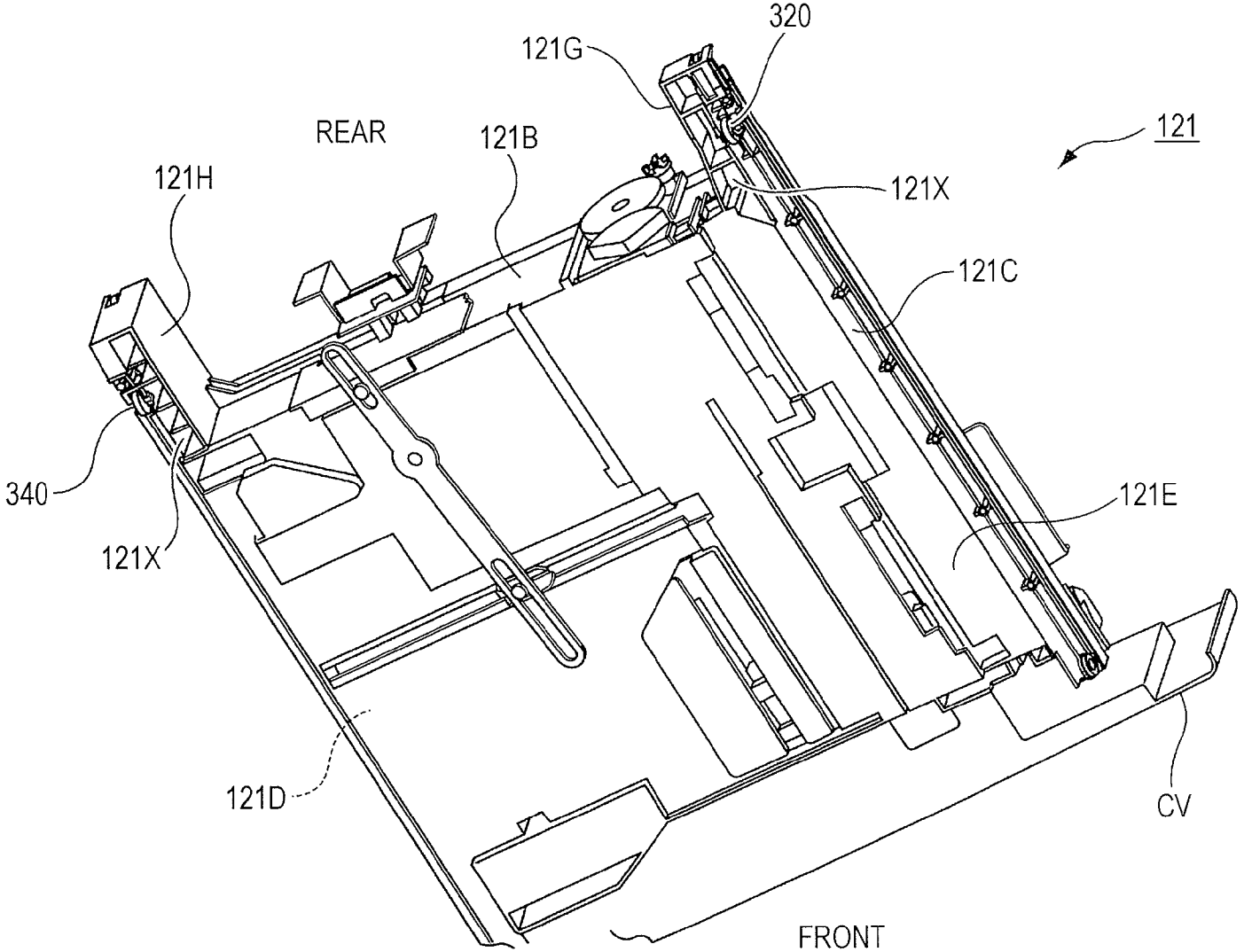
FIG. 3 is a perspective view of the second sheet storing unit viewed from below.

FIG. 2 is a perspective view of the second sheet storing unit 121 viewed from above. FIG. 3 is a perspective view of the second sheet storing unit 121 viewed from below.

Referring to FIG. 2, the second sheet storing unit 121 is box-shaped or substantially box-shaped and includes a first side wall 121A located at the front, a second side wall 121B located opposite the first side wall 121A at the rear (at the back of the apparatus body 1A), a third side wall 121C arranged along the depth direction of the image forming apparatus 1, a fourth side wall 121D located opposite the third side wall 121C and arranged along the depth direction, and a bottom plate 121E. A cover CV is attached to the first side wall 121A of the second sheet storing unit 121. A cut section 70 is formed at the top edge of the second side wall 121B.

As illustrated in FIG. 3, the second sheet storing unit 121 includes a first projecting portion 121G and a second projecting portion 121H that project rearward from the outer side surfaces of the second side wall 121B. The first projecting portion 121G is arranged to be located on the extension of the third side wall 121C. The second projecting portion 121H is arranged to be located on the extension of the fourth side wall 121D. More specifically, the first projecting portion 121G is provided at one end of the second sheet storing unit 121 and the second projecting portion 121H is provided at the other end of the second sheet storing unit 121 in the width direction of the second sheet storing unit 121 (in the direction orthogonal to the depth direction of the image forming apparatus 1).

As illustrated in FIG. 2, the second sheet storing unit 121 also includes a first slide member 210 and a second slide member 220 that are provided on the bottom plate 121E in a slidable manner. The first slide member 210 is slidable along a transporting direction of the sheets P, and is brought into contact with rear ends of the sheets P in the transporting direction to align the sheets P in a stacked state. The second slide member 220 is slidable along a direction orthogonal to the transporting direction of the sheets P, and is brought into contact with the sheets P at one side thereof to align the sheets P in a stacked state.

In the present exemplary embodiment, a disc-shaped rotating member 310 is provided at the top of the first projecting portion 121G (see FIG. 2), and a disc-shaped rotating member 320 is provided at the bottom of the first projecting portion 121G (see FIG. 3). Similarly, a disc-shaped rotating member 330 is provided at the top of the second projecting portion 121H (see FIG. 2), and a disc-shaped rotating member 340 is provided at the bottom of the second projecting portion 121H (see FIG. 3). The rotating members 310 to 340 are guided and rotated by rails, which will be described below, when the second sheet storing unit 121 is pulled out from the apparatus body 1A (see FIG. 1) or attached to the apparatus body 1A. Thus, according to the present exemplary embodiment, the second sheet storing unit 121 may be more smoothly moved compared to the case in which the rotating members 310 to 340 are not provided.

In the present exemplary embodiment, protrusions (not shown) are formed on the bottom surfaces of the first projecting portion 121G and the second projecting portion 121H such that the protrusions project from the bottom surfaces. The protrusions come into contact with predetermined portions of the apparatus body 1A when the second sheet storing unit 121 is largely pulled out from the apparatus body 1A, and thereby regulate the movement of the second sheet storing unit 121. Thus, the second sheet storing unit 121 may be prevented from being excessively pulled out and being dropped, for example, as a result.

Although the protrusions may be provided on the bottom of the bottom plate 121E, the maximum amount by which the second sheet storing unit 121 may be pulled out will be reduced in such a case. If the maximum amount by which the second sheet storing unit 121 may be pulled out is reduced, the user cannot smoothly refill the second sheet storing unit 121 with the sheets P. More specifically, if the maximum amount by which the second sheet storing unit 121 may be pulled out is reduced, the second sheet storing unit 121 cannot be largely pulled out, which makes it difficult to smoothly refill the second sheet storing unit 121 with the sheets P. To avoid this, in the present exemplary embodiment, the first projecting portion 121G and the second projecting portion 121H are provided and the above-described protrusions are provided on the first projecting portion 121G and the second projecting portion 121H.

Figure 4:
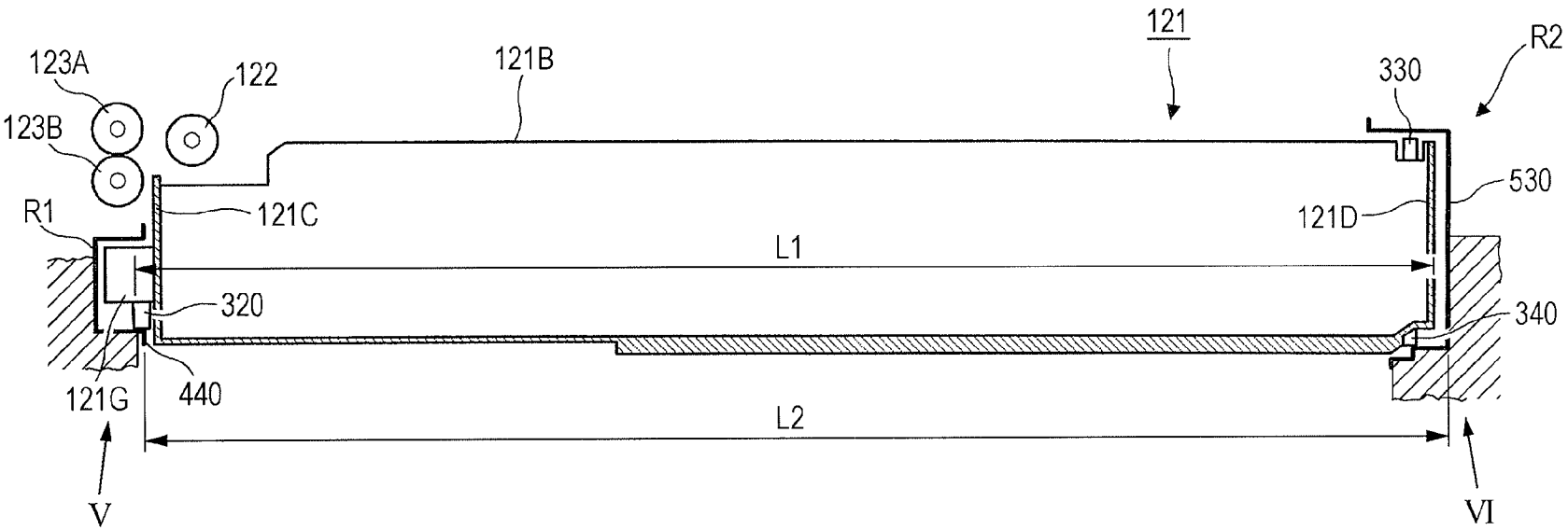
FIG. 4 illustrates the second sheet storing unit viewed from the front side of the image forming apparatus.
Figure 5:
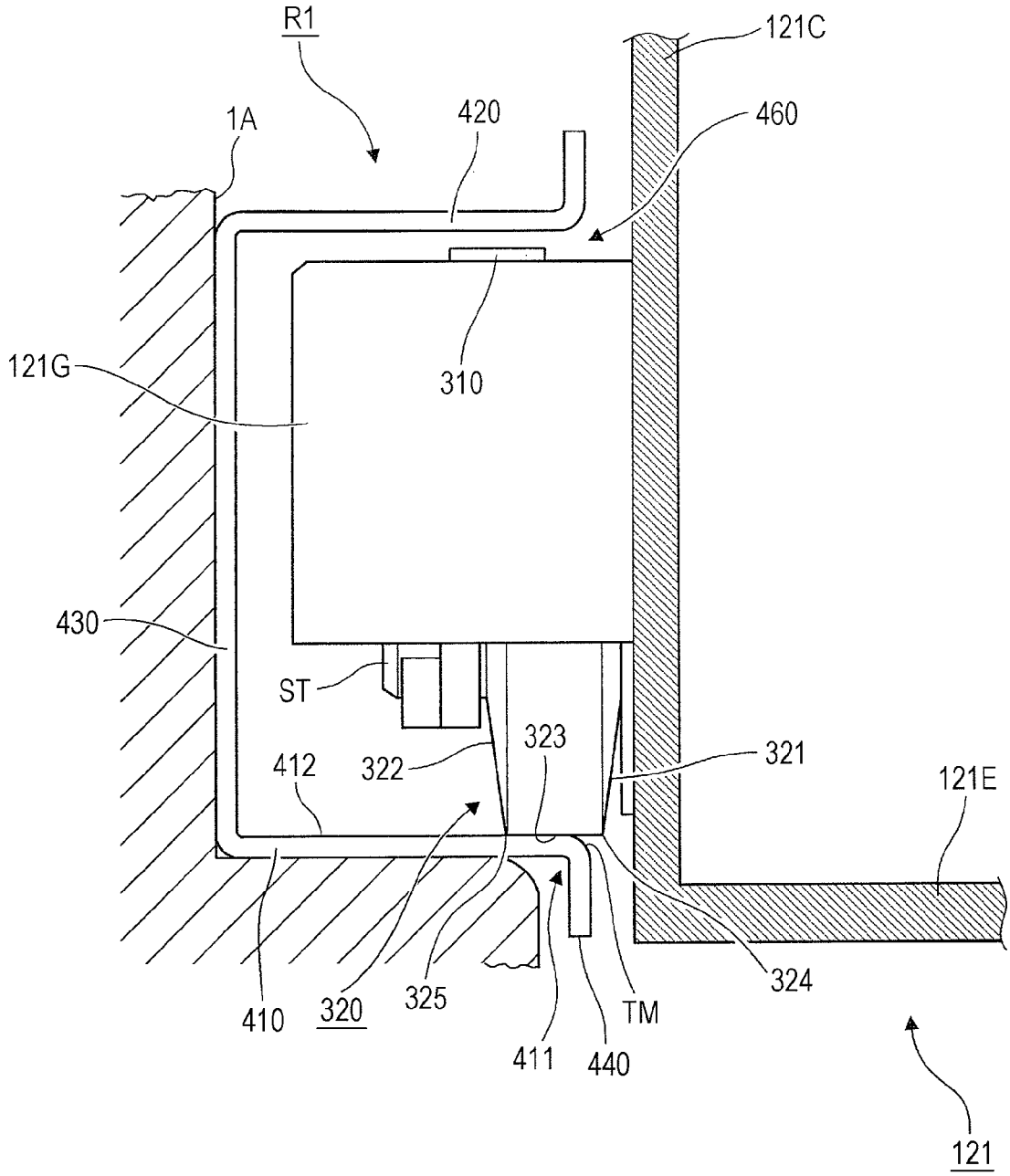
FIG. 5 is an enlarged view of part V in FIG. 4.
Figure 6:
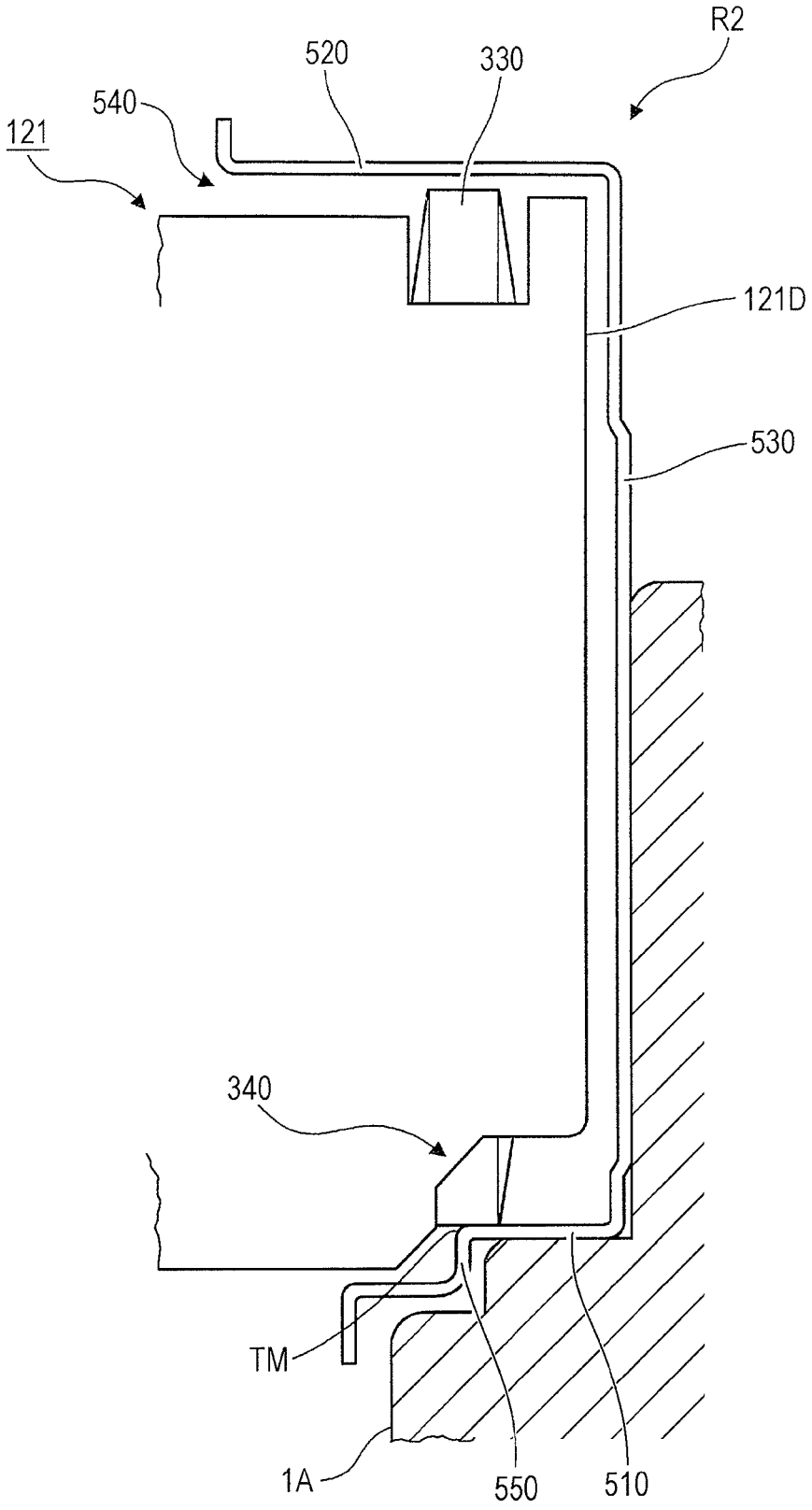
FIG. 6 is an enlarged view of part VI in FIG. 4.

FIG. 4 illustrates the second sheet storing unit 121 viewed from the front side of the image forming apparatus 1. FIG. 5 is an enlarged view of part V in FIG. 4, and FIG. 6 is an enlarged view of part VI in FIG. 4.

Referring to FIG. 4, the rotating member 320 (see also FIG. 3) provided at the bottom of the first projecting portion 121G is disposed outside the third side wall 121C (on the left side of the third side wall 121C in FIG. 4). In the present exemplary embodiment, a first rail R1 that guides the rotating members 310 and 320 on the first projecting portion 121G is provided in the apparatus body 1A (see FIG. 1) of the image forming apparatus 1. In addition, a second rail R2 that guides the rotating members 330 and 340 on the second projecting portion 121H is also provided in the apparatus body 1A of the image forming apparatus 1.

The first rail R1 will be described in more detail with reference to FIG. 5. The first rail R1 has an angular-U shape in cross section. The first rail R1 is formed by bending a sheet metal. The first rail R1 includes a support portion 410. The support portion 410 is disposed substantially horizontally and has an edge portion 411 at an end close to the second sheet storing unit 121. The support portion 410 supports the rotating member 320, which is provided at the bottom of the first projecting portion 121G, at the bottom thereof. The support portion 410 has a support surface 412 at the top, the support surface 412 supporting the rotating member 320. The first rail R1 also includes a counter portion 420 arranged so as to face the support portion 410 and positioned above the rotating member 310 provided at the top of the first projecting portion 121G. The counter portion 420 comes into contact with the rotating member 310 and guides the rotating member 310 when, for example, the second sheet storing unit 121 is pulled out.

Figure 9:
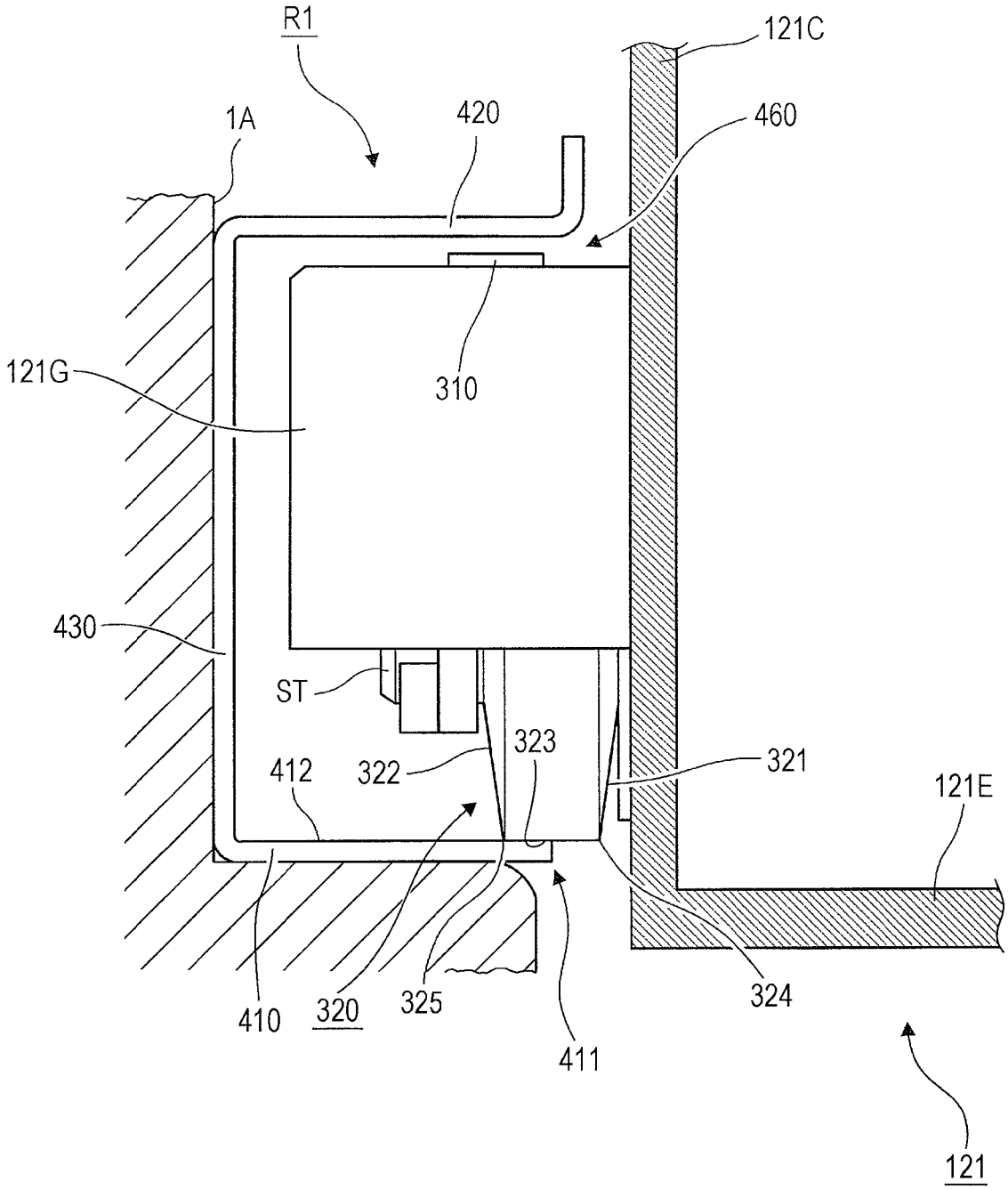
FIG. 9 illustrates a modification of a first rail.

The first rail R1 also includes a connecting portion 430 that is disposed vertically and that connects an end of the support portion 410 to an end of the counter portion 420. In the present exemplary embodiment, the first rail R1 is attached to the apparatus body 1A by fixing the connecting portion 430 to the apparatus body 1A. The first rail R1 has an opening 460 at the side at which the second sheet storing unit 121 is provided. The first rail R1 also includes a second counter portion 440 that extends downward from the other end of the support portion 410 (from the edge portion 411) and that faces the third side wall 121C of the second sheet storing unit 121. A counter surface TM of a bonding section between the support portion 410 and the second counter portion 440, the counter surface TM facing the third side wall 121C, is arc-shaped and has a certain curvature. More specifically, the counter surface TM is inclined such that the height of a point on the counter surface TM increases as the distance from the point to the third side wall 121C of the second sheet storing unit 121 increases. Although the second counter portion 440 is provided in the present exemplary embodiment, the second counter portion 440 may be omitted, as shown in FIG. 9, which illustrates a modification of the first rail R1. In other words, the structure may be such that an end of the support portion 410 is not subjected to bending and is simply cut off.

In the present exemplary embodiment, the rotating member 320 is disc-shaped. As illustrated in FIG. 5, the rotating member 320 has a first side surface 321 at a side at which the second sheet storing unit 121 is provided, and has a second side surface 322 at a side opposite to the side at which the second sheet storing unit 121 is provided. The rotating member 320 also has a peripheral surface 323 provided along the circumferential direction at the outer periphery thereof. The peripheral surface 323 does not have a curvature in the thickness direction of the rotating member 320, and is flat in the thickness direction. Accordingly, in the present exemplary embodiment, a first corner portion 324 is formed at a connecting portion between the peripheral surface 323 and the first side surface 321, and a second corner portion 325 is formed at a connecting portion between the peripheral surface 323 and the second side surface 322.

The rotating member 320 is formed such that the thickness thereof gradually decreases from the central section (axial center) thereof toward the peripheral surface 323. In other words, the thickness of the rotating member 320 at the outer periphery thereof is smaller than that at the central section thereof. More specifically, in the present exemplary embodiment, the first side surface 321 and the second side surface 322 are arranged so as to approach each other from the central section of the rotating member 320 toward the outer periphery thereof, so that the thickness of the rotating member 320 at the outer periphery thereof is smaller than that at the central section thereof. Although not described above, the rotating member 320 has a shaft ST that extends along the axial direction of the rotating member 320. In the present exemplary embodiment, the shaft ST is rotatably supported by the second sheet storing unit 121, so that the rotating member 320 is rotatable.

Next, the second rail R2 will be described with reference to FIG. 6. The second rail R2 has a structure similar to that of the first rail R1 except the structure is horizontally inverted. The second rail R2 is formed by bending a sheet metal, and has an angular-U shape in cross section. The second rail R2 includes a support portion 510 and a counter portion 520. The support portion 510 is disposed substantially horizontally and supports the rotating member 340, which is provided at the bottom of the second projecting portion 121H (see FIG. 2), at the bottom thereof. The counter portion 520 is arranged so as to face the support portion 510 and is positioned above the rotating member 330 provided at the top of the second projecting portion 121H. The counter portion 520 comes into contact with the rotating member 330 and guides the rotating member 330 when, for example, the second sheet storing unit 121 is pulled out.

The second rail R2 also includes a connecting portion 530 that is disposed vertically and that connects an end of the support portion 510 to an end of the counter portion 520. The second rail R2 has an opening 540 at the side at which the second sheet storing unit 121 is provided. The second rail R2 also includes a second counter portion 550 that extends downward from the other end of the support portion 510 and that faces the second sheet storing unit 121. A counter surface TM of a bonding section between the support portion 510 and the second counter portion 550, the counter surface TM facing the second sheet storing unit 121, is arc-shaped and has a certain curvature.

Referring to FIG. 4 again, the second sheet storing unit 121 will be further described.

In the present exemplary embodiment, the distance between the fourth side wall 121D and the second corner portion 325 (see FIG. 5) of the rotating member 320 is set to L1. In addition, the distance between the connecting portion 530 of the second rail R2 and the second counter portion 440 (see also FIG. 5) of the first rail R1 is set to L2. In the present exemplary embodiment, the dimensions of the components are set such that L1>L2 is satisfied. In the present exemplary embodiment, since L1>L2 is satisfied, even when the second sheet storing unit 121 is pushed rightward in FIG. 4 by the user and is moved rightward in FIG. 4, the state in which the rotating member 320 is placed on the first rail R1 may be maintained.

In addition, in the present exemplary embodiment, the support portion 410 of the first rail R1 is disposed in an area that is opposed to the outer surface of the third side wall 121C of the second sheet storing unit 121, as illustrated in FIG. 5. In addition, in the present exemplary embodiment, the support portion 410 is positioned above the bottom plate 121E of the second sheet storing unit 121. Accordingly, in the present exemplary embodiment, the dimension of the image forming apparatus 1 in the height direction thereof may be reduced.

The support portion 410 may be disposed at a position lower than the position illustrated in FIG. 5, and the length thereof may be increased such that the support portion 410 extends to the bottom section of the bottom plate 121E. However, in such a case, the dimension of the image forming apparatus in the height direction thereof is increased by an amount corresponding to the dimension of the support portion 410. In particular, in the image forming apparatus 1 according to the present exemplary embodiment, plural sheet storing units are provided. Therefore, if each of the sheet storing units is structured as described above, it becomes difficult to reduce the size of the image forming apparatus 1.

To avoid this, in the present exemplary embodiment, the support portion 410 is disposed in an area that is opposed to the outer surface of the third side wall 121C, and is positioned above the bottom plate 121E of the second sheet storing unit 121.

In the present exemplary embodiment, the dimension of the image forming apparatus 1 in the width direction thereof is reduced by appropriately setting the dimensions of the components. More specifically, in the present exemplary embodiment, the rotating member 320 is arranged so as to protrude from the edge portion 411 of the first rail R1, as illustrated in FIG. 5. In other words, in the thickness direction of the rotating member 320, the peripheral surface 323 of the rotating member 320 is not entirely in contact with the support portion 410, and only a part of the peripheral surface 323 is in contact with the support portion 410.

In addition, in the present exemplary embodiment, the sending-out roller 122 is disposed in the second sheet storing unit 121, as illustrated in FIG. 4. More specifically, the sending-out roller 122 is disposed such that the bottom end of the sending-out roller 122 (position at which the sending-out roller 122 is in contact with the topmost sheet P) is positioned below the upper edge of the second sheet storing unit 121. Accordingly, the dimension of the image forming apparatus 1 in the height direction thereof may be further reduced. When the second sheet storing unit 121 is pushed into the apparatus body 1A, the sending-out roller 122 enters the second sheet storing unit 121 through the cut section 70 (see FIG. 2) formed in the second side wall 121B.

As described above, the dimensions of the components are set such that L1>L2 is satisfied. Accordingly, as described above, the state in which the rotating member 320 is placed on the first rail R1 is maintained even when the second sheet storing unit 121 is moved rightward in FIG. 4. In the present exemplary embodiment, the second sheet storing unit 121 is made of resin and is elastically deformable. In addition, the first projecting portion 121G and the second projecting portion 121H have a cantilever structure, and are easily deformed. Although not described above, plural recesses 121X are formed in the back surface of the second sheet storing unit 121, as illustrated in FIG. 3, owing to the molds formed to form the second sheet storing unit 121.

Accordingly, in the present exemplary embodiment, there is a risk that the first projecting portion 121G be deformed and the rotating member 320 will drop off the first rail R1 when the second sheet storing unit 121 is attached or detached. In other words, there is a risk that the rotating member 320 will move beyond the edge portion 411 (see FIG. 5) toward the side at which the second sheet storing unit 121 is provided and drop off the first rail R1. More specifically, there is a risk that the rotating member 320 will move beyond the edge portion 411 toward the side at which the second sheet storing unit 121 is provided and drop downward (example of a certain direction).

Accordingly, in the present exemplary embodiment, the rotating member 320 is formed such that the thickness thereof gradually decreases from the axial center toward the peripheral surface 323. In the rotating member 320 of the present exemplary embodiment, the second side surface 322 (example of a counter surface), which faces the edge portion 411 (see FIG. 5) when the rotating member 320 drops off the first rail R1, is inclined. More specifically, the second side surface 322 is inclined such that a point on the second side surface 322 approaches the side at which the edge portion 411 is provided as the point moves upward (in a direction opposite to the certain direction). As a result, in the present exemplary embodiment, even when the rotating member 320 drops off the first rail R1, the rotating member 320 may easily move back onto the first rail R1.

More specifically, in the present exemplary embodiment, if the rotating member 320 drops off the first rail R1, the second side surface 322 of the rotating member 320 is pressed against the edge portion 411 by the resilience of the first projecting portion 121G that is elastically deformed. Then, in the present exemplary embodiment, when the second sheet storing unit 121 is moved and the rotating member 320 is rotated accordingly, the rotating member 320 is moved upward and goes back onto the first rail R1. In the present exemplary embodiment, as described above, the counter surface TM (see FIG. 5) of the bonding section between the support portion 410 and the second counter portion 440, the counter surface TM facing the third side wall 121C, is arc-shaped and has a certain curvature. Therefore, according to the present exemplary embodiment, the rotating member 320 may easily go back to the original position. Although detailed descriptions will be omitted here, the second projecting portion 121H has a similar structure. That is, a side surface of the rotating member 340 (see FIG. 6) is inclined, and the rotating member 340 may easily go back onto the second rail R2 even when the rotating member 340 drops off the second rail R2. The counter surface TM may be formed as a surface that does not have a curvature. Namely, the counter surface TM may be formed as a flat, inclined surface.

Figure 7:
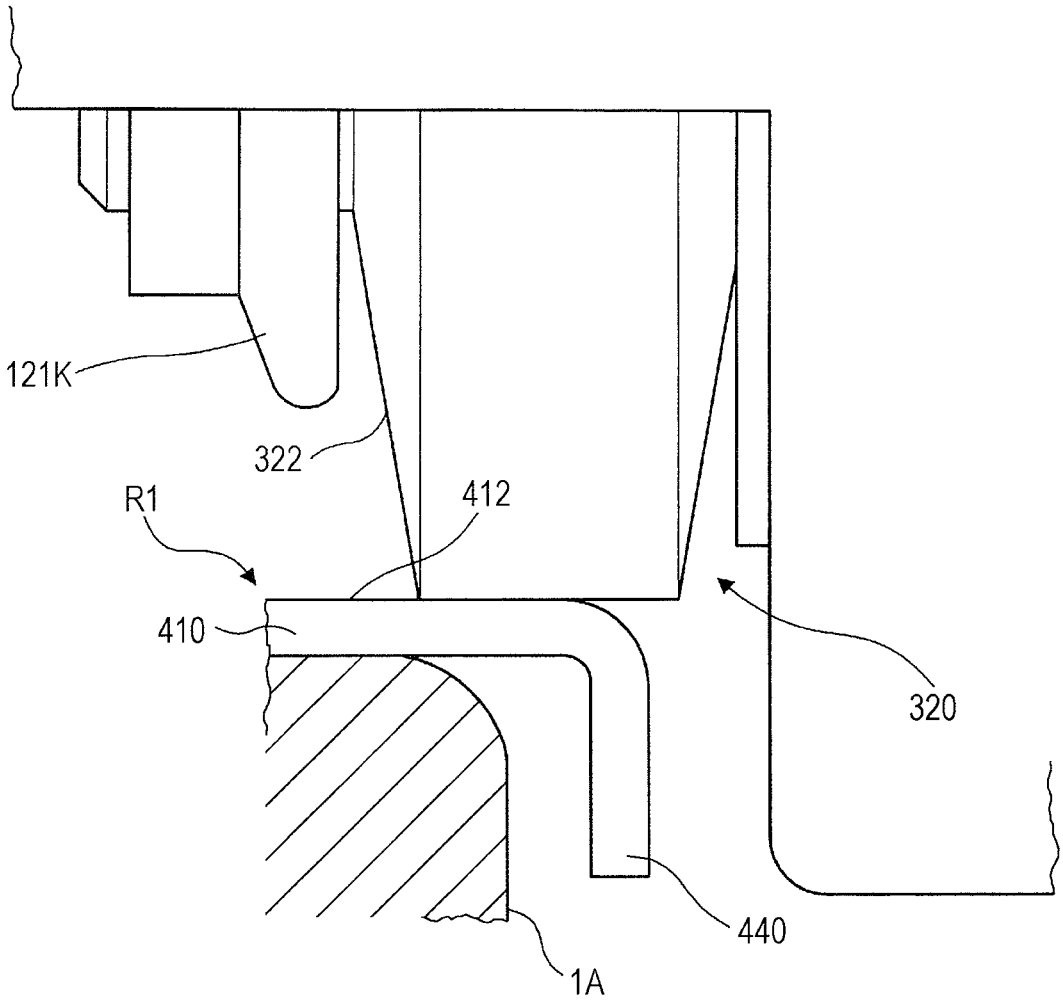
FIG. 7 is an enlarged view of a section around a rotating member.
Figure 8:
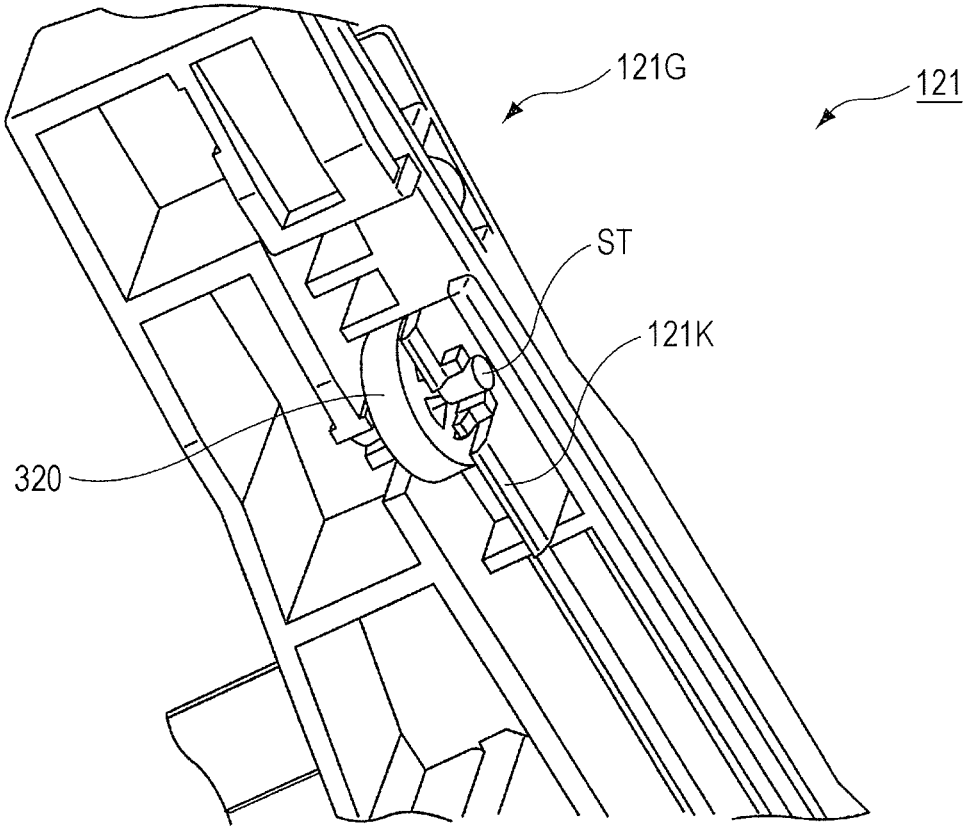
FIG. 8 is a perspective view of a first projecting portion viewed from below.

FIG. 7 is an enlarged view of a section around the rotating member 320. FIG. 8 is a perspective view of the first projecting portion 121G viewed from below.

FIGS. 7 and 8 illustrate an exemplary embodiment in which a reducing member 121K (example of a regulating portion) that reduces an amount of drop of the rotating member 320 is provided. As illustrated in FIG. 7, the reducing member 121K is provided on the rotating member 320 at a position where the reducing member 121K faces the second side surface 322.

Referring to FIG. 8, the reducing member 121K is formed in a plate shape that extends in the depth direction of the second sheet storing unit 121. The reducing member 121K has a notch for receiving the shaft ST of the rotating member 320. The rotating member 320 is positioned and retained by the notch. If the rotating member 320 drops, an end portion of the reducing member 121K comes into contact with the support surface 412 of the support portion 410, and further movement (downward movement) of the rotating member 320 is stopped. As a result, the amount of drop of the rotating member 320 is reduced. When the amount of drop of the rotating member 320 is reduced, the rotating member 320 may easily go back onto the first rail R1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a recording-medium storing unit including a rotating member wherein the rotating member is attached to a bottom of a projection portion of the recording medium storing unit, the recording-medium storing unit being capable of being pulled out from an apparatus body;

a support surface having an edge portion, the support surface supporting the rotating member when the recording-medium storing unit is pulled out from the apparatus body;

an image forming unit that forms an image on a recording medium fed from the recording-medium storing unit; and a regulating portion that comes into contact with the support surface and regulates the movement of the rotating member in a certain direction when the rotating member drops off the support surface, wherein the regulating portion is provided on the rotating member and has a notch for receiving a shaft of the rotating member, wherein the rotating member has a counter surface that faces the edge portion of the support surface when the rotating member moves beyond the edge portion and drops off the support surface in the certain direction, and wherein, in the state in which the counter surface faces the edge portion, the counter surface is inclined such that a point on the counter surface approaches the edge-portion side as the point moves in a direction opposite to the certain direction.

2. The image forming apparatus according to claim 1, wherein the recording-medium storing unit is substantially box-shaped, and wherein the support surface is provided in an area that is opposed to a side surface of the substantially box-shaped recording-medium storing unit.

3. The image forming apparatus according to claim 1, wherein the recording-medium storing unit includes a substantially box-shaped portion that is substantially box-shaped and has a plurality of side surfaces, the substantially box-shaped portion storing the recording medium, and the projecting portion projects from one of the side surfaces that is positioned at a back side of the apparatus body.

4. The image forming apparatus according to claim 2, wherein the recording-medium storing unit includes a substantially box-shaped portion that is substantially box-shaped and has a plurality of side surfaces, the substantially box-shaped portion storing the recording medium, and the projecting portion projects from one of the side surfaces that is positioned at a back side of the apparatus body.

5. The image forming apparatus according to claim 1, wherein the thickness of the rotating member gradually decreases from an axial center of the rotating member toward a peripheral surface of the rotating member.

6. A sheet feeding device comprising:

a sheet storing unit including a rotating member wherein the rotating member is attached to a bottom of a projection portion of the recording medium storing unit, the recording-medium storing unit being capable of being pulled out from an apparatus body;

a support surface having an edge portion, the support surface supporting the rotating member when the recording-medium storing unit is pulled out from the apparatus body; and a regulating portion that comes into contact with the support surface and regulates the movement of the rotating member in a certain direction when the rotating member drops off the support surface, wherein the regulating portion is provided on the rotating member and has a notch for receiving a shaft of the rotating member, wherein the rotating member has a counter surface that faces the edge portion of the support surface when the rotating member moves beyond the edge portion and drops off the support surface in a downward direction, and wherein, in the state in which the counter surface faces the edge portion, the counter surface is inclined such that a point on the counter surface approaches the edge-portion side as the point moves upward.

7. The sheet feeding device according to claim 6, further comprising:

a sending-out member that is in contact with the topmost one of sheets stored in the sheet storing unit and sends out the topmost sheet, and wherein a part of the sending-out member that is in contact with the topmost sheet is positioned below an upper edge of the sheet storing unit that is substantially box-shaped.

8. The sheet feeding device according to claim 6, wherein the sheet storing unit is substantially box-shaped, and wherein the support surface is provided in an area that is opposed to a side surface of the substantially box-shaped sheet storing unit, and is positioned above a bottom surface of the sheet storing unit.

9. The sheet feeding device according to claim 7, wherein the sheet storing unit is substantially box-shaped, and wherein the support surface is provided in an area that is opposed to a side surface of the substantially box-shaped sheet storing unit, and is positioned above a bottom surface of the sheet storing unit.

10. The sheet feeding device according to claim 6, wherein the thickness of the rotating member gradually decreases from an axial center of the rotating member toward a peripheral surface of the rotating member.

* * * * *